United States Patent [19]

Sapiejewski

[11] Patent Number: 4,975,966

[45] Date of Patent: Dec. 4, 1990

[54] REDUCING MICROPHONE PUFF NOISE

[75] Inventor: Roman Sapiejewski, Boston, Mass.

[73] Assignee: Bose Corporation, Framingham, Mass.

[21] Appl. No.: 398,131

[22] Filed: Aug. 24, 1989

[51] Int. Cl.[5] ..... H04R 1/28

[52] U.S. Cl. ..... 381/189; 381/168; 381/153; 181/151; 181/158; 181/241

[58] Field of Search ..... 381/169, 153, 154, 158, 381/159, 161, 168, 189; 181/242, 158, 151

[56] References Cited

U.S. PATENT DOCUMENTS

| | | | |
|---|---|---|---|
| 2,623,957 | 12/1952 | Cragg et al. | 181/242 |
| 2,680,787 | 6/1954 | Olson et al. | 381/158 |
| 2,751,441 | 6/1956 | Olson et al. | 381/158 |
| 3,548,121 | 12/1970 | Gorike | 381/168 |
| 3,642,558 | 2/1972 | Gorike | 381/168 |
| 4,065,648 | 12/1977 | Cvetko et al. | 381/168 |
| 4,525,817 | 6/1985 | Takuya | 381/158 |
| 4,570,746 | 2/1986 | Das et al. | 381/158 |
| 4,633,045 | 12/1986 | Bartlett | 381/159 |
| 4,694,499 | 9/1987 | Bartlett | 381/169 |
| 4,768,614 | 9/1988 | Case | 381/169 |

FOREIGN PATENT DOCUMENTS

| | | | |
|---|---|---|---|
| 2162994 | 6/1973 | Fed. Rep. of Germany | 381/169 |
| 55-130296 | 10/1980 | Japan | 381/169 |
| 56-52993 | 5/1981 | Japan | 381/169 |
| 56-68094 | 6/1981 | Japan | 381/168 |
| 59-62294 | 9/1984 | Japan | 381/153 |

OTHER PUBLICATIONS

Journal of the Audio Engineering Society, "Audio-Technica Ad", Jul./Aug. 1984, p. 569.

*Primary Examiner*—Forester W. Isen
*Attorney, Agent, or Firm*—Fish & Richardson

[57] ABSTRACT

A low puff boom microphone includes a protective grid covering an end portion of the microphone housing, a microphone capsule near the protective grid, a layer of material between the protective grid and microphone capsule, a spacer between the layer of material, and an open area laterally of the spacer.

11 Claims, 1 Drawing Sheet

REDUCING MICROPHONE PUFF NOISE

(1) TECHNICAL FIELD

This invention relates to boom microphones which use "noise-cancelling" capsules such as dipole (velocity sensitive) microphones.

(2) BACKGROUND

Boom microphones are intended to be used very close to the speaker's lips to maximize the noise cancelling effect of the enclosed microphone capsules. Locating the microphone close to the lips often causes undesirable sounds to be generated. Certain speech sounds which produce high air velocities at the lips such as plosives (sounds such as p, t, and d) generate "puff noise". The noise is caused by the turbulence created when high air velocities coming from the lips strike the protective grid which is commonly provided to cover the microphone capsule. A prior art approach to reduce "puff noise" in currently available microphones is to place a layer of foam directly between the microphone element and the protective grid. The thickness of this layer of foam must be minimized to keep the microphone capsule close to the lips for good noise-cancelling effect. A certain amount of "puff noise" still passes through to the microphone capsule.

An object of this invention is to reduce the amount of puff noise associated with boom type microphones.

SUMMARY OF THE INVENTION

According to the invention, a boom microphone for reducing puff noise includes a protective grid, a layer of material, a spacer, a structure defining an open area located laterally of the spacer, and a microphone capsule, all contained by a housing. The spacer has a radiation impedance level of magnitude so that the spacer reduces the puff noise transmitted therethrough to the microphone capsule. The structure defining an open area located laterally of the spacer allows puff noise to exit outside the housing through the open area. The layer of material and spacer transmit speech and ambient nosie sounds to the microphone capsule without significantly affecting the latter sounds. The layer of material used in the boom microphone can comprise a variety of materials, including foam and resistive material. The spacer in the boom microphone can also comprise a variety of substances, including air and open cell foam. The layer of material and spacer cover the microphone capsule inside the housing.

The microphone capsule, located in the boom microphone, is a "noise cancelling" capsule which must be placed close to the user's lips to be effective. The location of the microphone capsule close to the lips sometimes results in turbulence, also referred to as puff noise. This turbulence is caused by speech sounds with high air velocities. This invention reduces puff noise by locating a spacer between the microphone capsule and the layer of material and locating a structure defining an open area laterally of the spacer. The structure defining the open area is included to open up the cavity accomodating the spacer.

The thickness of the layer of material and spacer in the boom microphone affects the amount of puff noise that is reduced. As the thickness of the layer of material and spacer is increased the amount of puff noise is reduced, but the noise cancelling effect is also reduced because there is a greater distance between the speaker's lips and the microphone capsule. The noise cancelling effect of the microphone capsule is more effective at closer ranges to the speaker's lips. An acceptable thickness may be determined experimentally.

BRIEF DESCRIPTION OF THE DRAWINGS

The foregoing and other objects, features, and advantages of the invention will be apparent from the following more particular description of preferred embodiments, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
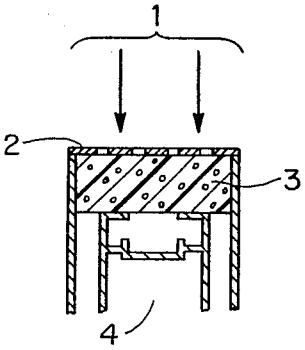
FIG. 1 is a perspective view of a prior art boom microphone.

FIG. 1 illustrates the primary elements of a prior art boom microphone system. Air flow 1 generated by the speaker's voice is directed toward protective grid 2. Air flow 1 passes through portective grid 2 and into open cell foam 3 generating turbulence. The air flow then passes through open cell foam 3 and into microphone capsule 4, carrying some of the turbulence-induced noise with it. The layer of open cell foam 3 is only partially effective in reducing the amount of turbulence-induced noise or puff noise.

Figure 2:
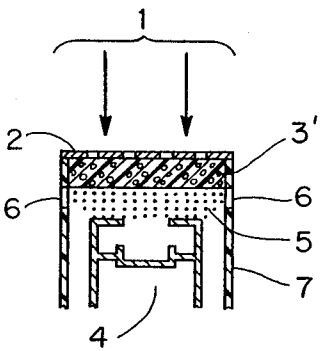
FIG. 2 is a perspective view of a low puff boom microphone embodying the principles of this invention.

FIG. 2 illustrates an embodiment of the invention. The air flow 1 passes through protective grid 2 and into dense open cell foam 3'. Air flow 1 then encounters spacer 5 which has a radiation impedance approaching that of free air. This impedance level reduces the amount of turbulence-induced noise which is transmitted through spacer 5 to microphone capsule 4. Open area 6 provides a means for the puff noise to exit. Sounds, such as speech and ambient noise, are not significantly affected by the presence of foam 3' and spacer 5 and are transmitted to microphone capsule 4. The thickness of the space between microphone capsule 4 and protective grid 2 affects the efficiency of the boom microphone. The thickness of dense open cell foam 3' and spacer 5 is a trade-off between the noise cancelling effect (which is reduced as the space increases and the microphone is moved further from the speaker's lips) and reduction of puff noise. An acceptable distance may be determined experimentally.

Figure 3:
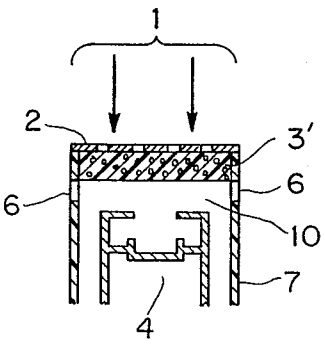
FIG. 3 is a perspective view of a low puff boom microphone using an air gap as the spacer.

FIG. 3 illustrates another embodiment and includes using an air gap 10 as spacer 5 and holding the dense foam and microphone capsule apart inside plastic housing 7 which contains protective grid 2.

Figure 4:
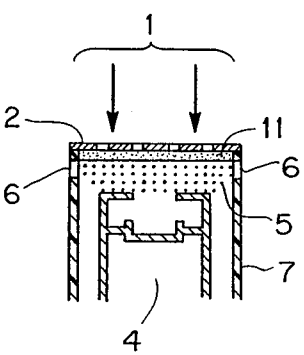
FIG. 4 is a perspective view of a low puff boom microphone using resistive material.

FIG. 4 illustrates another embodiment and includes using a resistive material 11 such as fine mesh cloth as the open cell foam layer 3'. The advantage of using fine mesh cloth is that the thickness of a fine mesh cloth for a given resistance to air flow is less than the thickness of foam 3'.

The invention is preferably constructed with a plastic protective grid, a 2 mm thick layer of 80 pore per inch open cell foam as the layer of material, a 2 mm thick layer of 30 pore per inch foam as the spacer, a microphone capsule, and a plastic housing.

While the inventon has been particularly shown and described with the reference to preferred embodiments thereof, it will be understood by those skilled in the art that various changes in form and details may be made without departing from the spirit and scope of the invention as defined by the appended claims. Other embodiments are within the claims.

What is claimed is:

1. A microphone for reducing puff noise having a microphone housing comprising:

(a) a protective grid covering an end portion of the microphone housing;

(b) a microphone capsule situated within said microphone housing near said protective grid;

(c) a layer of material located between said protective grid and said microphone capsule;

(d) a spacer having a radiation impedance level of magnitude so that said spacer reduces the puff noise transmitted therethrough to said capsule located between said layer of material and said capsule; and (e) a structure defining an open area located laterally of said spacer for allowing puff noise to exit outside said housing through said open area, said layer of material and said spacer transmitting speech and ambient noise sounds to said capsule without significantly affecting such sounds.

2. The microphone of claim 1 wherein the thickness of said material is sufficient to stop direct air flow when said microphone is used brushing the user's lips.

3. The microphone of claim 1 wherein said material layer is 2 mm thick.

4. The microphone of claim 3 wherein said material is a layer of 80 pore per inch open cell foam.

5. The microphone of claim 4 wherein said spacer is 2 mm thick.

6. The microphone of claim 4 wherein said spacer is a layer of 30 pore per inch foam.

7. The microphone of claim 4 wherein said open area comprises at least two openings.

8. The microphone of claim 1 wherein said material is resistive material.

9. The microphone of claim 8 wherein said resistive material is a fine mesh cloth.

10. The microphone of claim 1 wherein the spacer is an air gap.

11. The microphone of claim 1 wherein said material is open cell foam.

* * * * *